United States Patent [19]

Schmidt

[11] Patent Number: 4,557,211

[45] Date of Patent: Dec. 10, 1985

[54] FORM STABILIZED LOW WATER PLANE AREA TWIN HULL VESSELS

[75] Inventor: Terrence W. Schmidt, Santa Clara, Calif.

[73] Assignee: Lockheed Missiles & Space Co., Inc., Sunnyvale, Calif.

[21] Appl. No.: 602,440

[22] Filed: Apr. 20, 1984

[51] Int. Cl.[4] ..... B63B 1/12

[52] U.S. Cl. ..... 114/61; 114/283

[58] Field of Search ..... 114/56, 57, 61, 123, 114/283, 292

[56] References Cited

U.S. PATENT DOCUMENTS

| | | | |
|---|---|---|---|
| 2,464,957 | 3/1949 | Wood | 114/61 |
| 3,447,502 | 6/1969 | Leopold | 114/61 |
| 3,623,444 | 11/1971 | Lang | 114/61 |
| 3,847,103 | 11/1974 | Takeuchi | 114/61 |
| 3,897,744 | 8/1975 | Lang | 114/61 |
| 4,002,132 | 1/1977 | Nitzki | 114/61 |

FOREIGN PATENT DOCUMENTS

| | | | |
|---|---|---|---|
| 60788 | 5/1981 | Japan | 114/61 |
| 6803112 | 9/1968 | Netherlands | 114/61 |

*Primary Examiner*—David H. Brown

*Attorney, Agent, or Firm*—H. Donald Volk

[57] ABSTRACT

The present invention is directed to a vessel that is form stabilized. The stability is achieved by the particular shape or orientation of the struts or both. In one embodiment the dihedral struts have a cambered cross-section area. In another embodiment the cross-section area of the struts are symetrical and the struts are mounted in a toe out position.

2 Claims, 7 Drawing Figures

FORM STABILIZED LOW WATER PLANE AREA TWIN HULL VESSELS

TECHNICAL FIELD

This invention relates to strut geometry for trim control of small water plane area twin hull design watercraft. More specifically, the configuration of the present invention incorporates dihedral struts that are skewed relative to the centerline of the vessel or incorporate camber shapes.

BACKGROUND ART

Semisubmerged or small water plane area twin hull ships, sometimes referred to as SWATH ships, have been developed for high-speed operation at high sea states. U.S. Pat. Nos. 3,623,444 and 3,897,744 issued to Thomas G. Lang, disclosed ships of this configuration which have better operational characteristics than conventional ships and can operate at much higher sea states.

The above-noted patents point out a number of configurations for such vessels. One of these configurations include a rear stabilizer and a forward canard for counterbalancing the sinkage and trim forces exerted by the vessel itself. Because these control surfaces must counterbalance these forces, their utility in controlling the ship's motion and steerage is greatly reduced, or substantially larger control surfaces must be utilized. Larger control surfaces require additional machinery and degrade the overall performance of the ship.

DISCLOSURE OF INVENTION

In accordance with the present invention, the vessel is form stabilized. This is achieved by utilizing struts with a dihedral angle that incorporate cambering of section or non-parallel alignment or both.

BEST METHOD OF CARRYING OUT THE INVENTION

Figures 1, 2, 3:
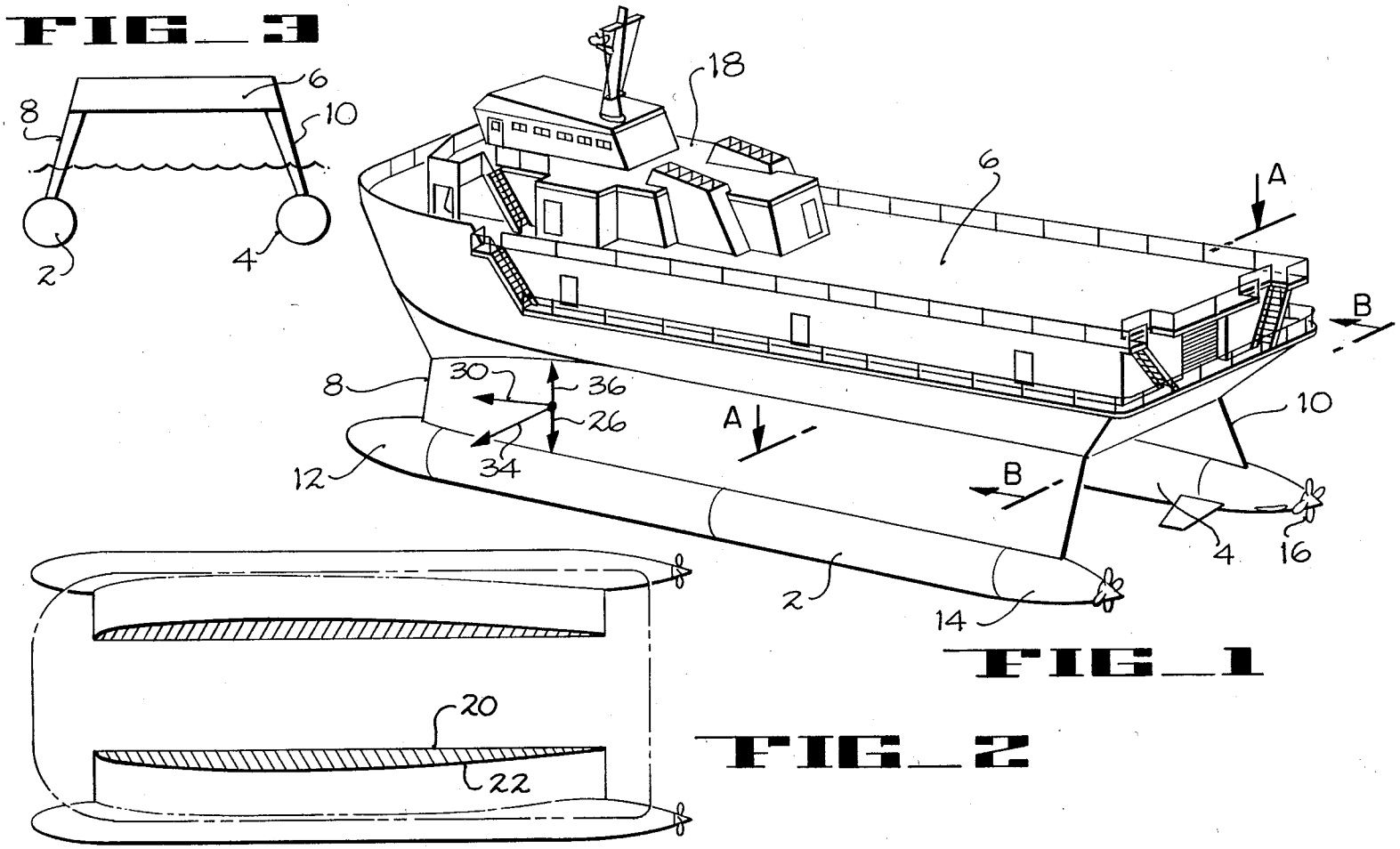
FIG. 1 is an isometric view of a vessel, of the present invention.
FIG. 2 is a sectional view of the vessel of FIG. 1 taken along the line A—A illustrating the cambered shape of the struts.
FIG. 3 is a sectional view of the vessel of FIG. 2 taken along the line B—B showing the negative dihedral angle of the strut relative to the upper hull.

One form of the invention is depicted in FIG. 1. A pair of essentially tubular shaped parallel submerged hulls 2 and 4 provide a buoyancy support for the upper hull 6 through a pair of dihedral struts 8, 10, which are cambered in section. Each of the submerged hulls 2 and 4 are made in the form of a long cylindrical shape, including a rounded bow 12 and a tapered stern 14.

Individual propellers 16 are mounted on the aft end of each of the submerged hulls 2 and 4. The propellers 16 are connected through a suitable transmission to a single power plant, or two individual power plants, to provide forward and reverse thrusts for movement of the vessel.

For illustration, the upper hull 6 is shown as a platform and includes a raised forward superstructure 18. Incorporated within the platform are the necessary ship machinery, storage holds, crew quarters, and the like.

By convention, when the angle between two objects exceeds 90°, the two objects are said to form a negative dihedral angle. Conversely, when the angle between the two objects is less than 90°, the objects are said to form a positive dihedral angle.

The supporting struts 8 and 10 are formed with a negative dihedral angle to the vertical and incorporate positive section camber. This would be best understood with the reference to FIG. 2 and FIG. 3. FIG. 2 is a section taken along lines A—A of FIG. 1 and shows the struts in section. The cross-sectional shape of the struts is defined by the camber or inboard and outboard surface curvature. When the curvature of the outboard surface 22 is greater than inboard 20 as illustrated here, the strut is said to have positive section camber. In FIG. 2 the inboard surface 20 is shown as an essentially straight surface but it could be curved if desired provided its curvature does not exceed that of the outboard surface. FIG. 3 which is a cut-away view of FIG. 1 taken along the line B—B shows the negative dihedral angle of the struts relative to the upper hull 6 and the submerged hulls 2 and 4.

Figure 5:
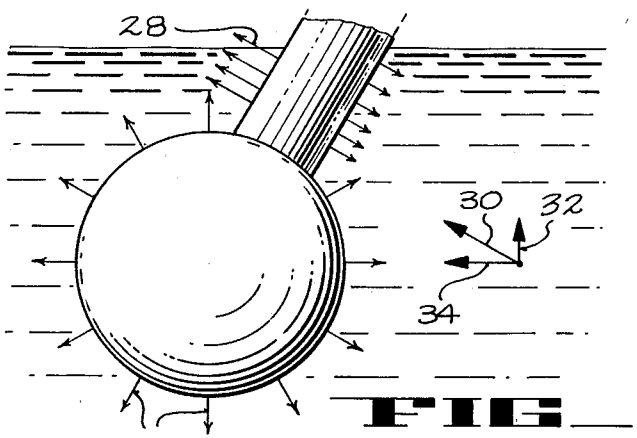
FIG. 5 is a simplified depiction of the hydrodynamic forces exerted on a cambered dihedral strut and submerged hull in accordance with the teachings of the present invention.
Figure 4:
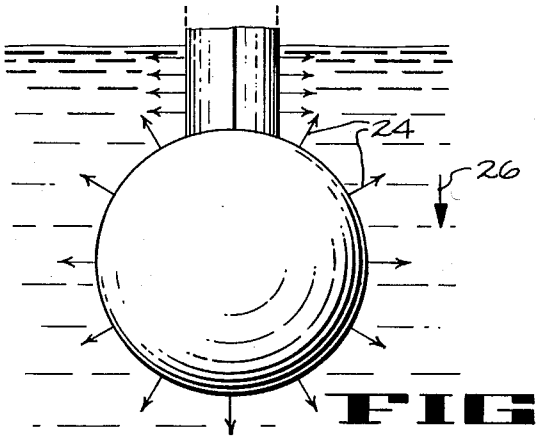
FIG. 4 is a simplified depiction of the hydrodynamic forces exerted on a vertical uncambered strut and submerged hull.

An understanding of how the vessel is form stabilized can be obtained by reference to FIG. 4 and FIG. 5. FIG. 4 is a simplified depiction of the pressure forces exerted on a single submerged vertical strut and hull of a SWATH vessel by the movement of the vessel through the water. It can be noted that the summation of the forces illustrated by arrows 24 produces a resultant force, shown by arrow 26, in the vertical direction. This resultant force 26, which can be called a sinking force is positioned forward on the hull causing the bow of the vessel to dive unless counteracting forces are provided by foils or canards.

FIG. 5 shows the pressure forces 28 exerted on a single submerged hull and a cambered dihedral support strut in accordance with the present invention. The summation of the forces on the strut are shown by arrow 30. Arrows 32 and 34 show the vertical and horizontal components, respectively, of the strut normal force. It will be understood that since the forces acting on the other dihedral support strut are symetrical with the forces shown in FIG. 5, the horizontal components cancel each other. As shown in FIG. 1, the vertical forces which are shown by arrows 36 and 26 add together and negate the vertical imbalance caused by the surface piercing strut. The resultant vertical force being zero.

Figure 6:
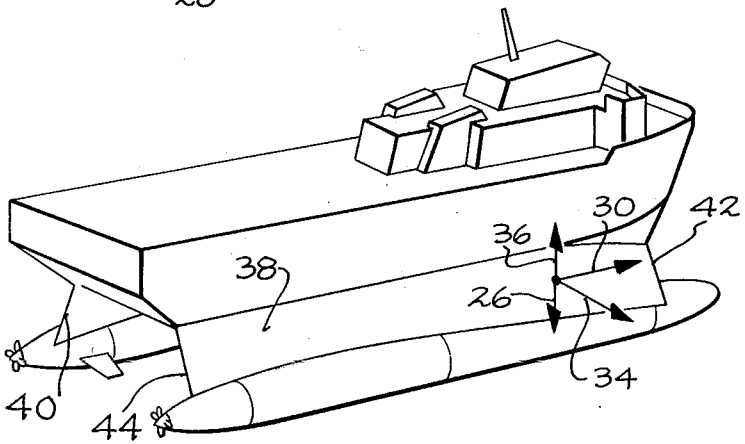
FIG. 6 is an isometric view of vessel showing another embodiment of the present invention.
Figure 7:
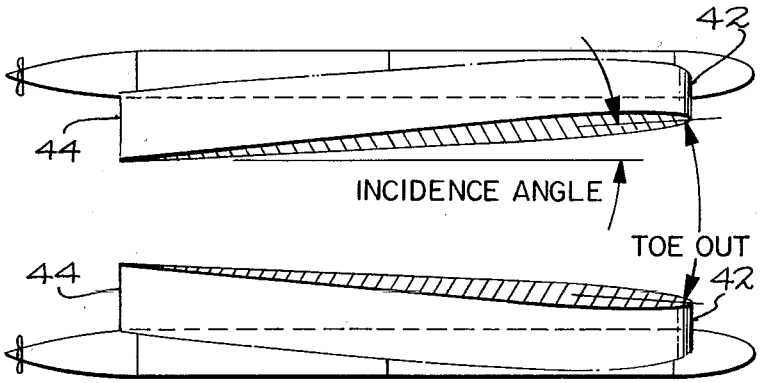
FIG. 7 is a sectional view of the vessel shown in FIG. 6 illustrating the toe out arrangement of the struts.

Another embodiment of the present invention is shown in FIG. 6 and FIG. 7. In this embodiment each of the dihedral struts 38 and 40 are symetrical in cross-section. The necessary vertical force needed to negate the vertical force imbalance caused by the surface piercing strut is obtained by aligning the struts in a non-parallel arrangement. In the embodiment, as shown, the distance between the leading edges 42 of the struts is greater than the distance between the trailing edges 44 of the struts, i.e., the struts are in a toe out arrangement.

It is understood that, if desired, the struts could be arranged in a toe in arrangement. In such an arrangement the resultant horizontal forces produced by each of the struts would be directed inboard of the vessel. However, since the struts are still symetrical with each other, the horizontal forces produced by the two struts will cancel each other out and leave a resultant force in the vertical direction as set forth above.

Other modification and advantageous applications of this invention will be apparent to those having ordinary skill in the art. Therefore, it is intended that the matter contained in the foregoing description and the accompanying drawings is illustrative and not limitative, the scope of the invention being defined by the appended claims.

I claim:

1. A form stabilized low water plane area twin hull vessel comprising: a pair of substantially tubular shaped parallel hulls that provide buoyancy support for the vessel, a pair of dihedral struts connected to said pair of parallel hulls and adapted to support an upper hull, and an upper hull connected to said pair of dihedral struts, wherein said pair of dihedral struts form a negative dihedral angle with said upper hull and wherein said struts include positive section camber.

2. A form stabilized low water plane area twin hull vessel comprising: a pair of substantially tubular shaped parallel hulls that provide buoyancy support for the vessel, a pair of dihedral struts connected to said pair of parallel hulls and adapted to support an upper hull, and an upper hull connected to said pair of dihedral struts, wherein said pair of dihedral struts each include a leading edge and a trailing edge and wherein the distance between said leading edges is greater than the distance between said trailing edges.

* * * * *